US008145490B2

(12) United States Patent
Tarrant et al.

(10) Patent No.: US 8,145,490 B2
(45) Date of Patent: Mar. 27, 2012

(54) PREDICTING A RESULTANT ATTRIBUTE OF A TEXT FILE BEFORE IT HAS BEEN CONVERTED INTO AN AUDIO FILE

(75) Inventors: Declan Tarrant, Killorglin (IE); Edward G. Mackle, Goatstown (IE); Eamon Phelan, Ballyraggit (IE); Keith Pilson, Clonsilla (IE)

(73) Assignee: Nuance Communications, Inc., Burlington, MA (US)

( * ) Notice: Subject to any disclaimer, the term of this patent is extended or adjusted under 35 U.S.C. 154(b) by 786 days.

(21) Appl. No.: 12/255,927

(22) Filed: Oct. 22, 2008

(65) Prior Publication Data

US 2009/0112597 A1 Apr. 30, 2009

(30) Foreign Application Priority Data

Oct. 24, 2007 (EP) ..... 07119206

(51) Int. Cl.
*G10L 13/00* (2006.01)

(52) U.S. Cl. ..... 704/258

(58) Field of Classification Search ..... 704/258–269
See application file for complete search history.

(56) References Cited

U.S. PATENT DOCUMENTS 5,555,343 A * 9/1996 Luther ..... 704/260
5,621,668 A * 4/1997 Nakata ..... 702/176
5,737,395 A * 4/1998 Irribarren ..... 379/88.13
5,752,228 A * 5/1998 Yumura et al. ..... 704/260
5,974,182 A * 10/1999 Bryniarski et al. ..... 382/232
6,360,198 B1 * 3/2002 Imai et al. ..... 704/207
7,062,758 B2 * 6/2006 Yokoyama ..... 717/136
7,174,295 B1 * 2/2007 Kivimaki ..... 704/260
7,191,131 B1 * 3/2007 Nagao ..... 704/258
7,558,732 B2 * 7/2009 Kustner et al. ..... 704/260
7,809,572 B2 * 10/2010 Yamagami et al. ..... 704/260
7,840,408 B2 * 11/2010 Yi et al. ..... 704/258
2007/0047646 A1 * 3/2007 Koh et al. ..... 375/240.03
2007/0094029 A1 * 4/2007 Saito et al. ..... 704/260
2007/0129948 A1 * 6/2007 Yi et al. ..... 704/260
2008/0151299 A1 * 6/2008 Takahata ..... 358/1.15
2009/0141990 A1 * 6/2009 Pigeon et al. ..... 382/233

* cited by examiner

*Primary Examiner* — Douglas Godbold
(74) *Attorney, Agent, or Firm* — Wolf, Greenfield & Sacks, P.C.

(57) ABSTRACT

An apparatus for predicting a resultant attribute of a text file before it has been converted to an audio file by a text-to-speech converter application. In accordance with an embodiment, the apparatus includes: a receiver component for receiving a text file and a request to determine a resultant attribute of the text file before it is converted to an audio file, by a text-to-speech converter component; a calculation component for determining a file type associated with the received text file and the size of the received text file; a calculation component for identifying an attribute associated with the determined file type; and a calculation component for determining from the identified attribute and the size of the received text file a resultant attribute of the text file before it is converted to an audio file by the text-to-speech converter component.

17 Claims, 5 Drawing Sheets

PREDICTING A RESULTANT ATTRIBUTE OF A TEXT FILE BEFORE IT HAS BEEN CONVERTED INTO AN AUDIO FILE

FIELD OF THE INVENTION

The invention relates to the field of text-to-speech conversion. In particular, the invention relates to a method and an apparatus for predicting a resultant attribute of a text file before it has been converted into an audio file.

BACKGROUND OF THE INVENTION

Text-to-speech conversion is a complex process whereby a stream of written text is converted into an audio output file. There are many known text-to-speech programs which convert text to audio. A conversion algorithm, in order to convert text-to-speech, has to understand the composition of the text that is to be converted. One known way in which text composition is performed is to split the text into what is known as phonemes. A phoneme can be thought of as the smallest unit of speech that distinguishes the meaning of a word. However, one disadvantage with this approach is that by breaking the text into phonemes the quality of the output speech is decreased because of the complexity of combining the phonemes once again to form the synthetic speech audio output file.

Another known method is to split phrases within a line of text not at the transition of one phrase to another but at the center of the phonemes, which leaves the transition intact (diphone method). This method results in better quality synthetic speech output but the resulting audio file uses more disk storage space.

Another form of text-to-speech conversion algorithm creates speech by generating sounds through a digitized speech method. The resulting output is not as natural sounding as the phoneme or diphones algorithms, but does have the advantage of requiring less storage space for the resulting converted speech.

Thus, there is a trade-off to be made between having a speech output which is very natural sounding and requiring a large amount of computation power and computer storage space and speech output which sounds computer generated and which does not require a large amount of computational power and a large amount of storage space.

Whichever type of text-to-speech algorithm is used for the conversion it is always difficult to determine how much storage space is required. This problem is compounded when the storage device is a portable storage device such as a USB device as it is difficult to predict how much of the converted data will fit onto the storage device.

A further complication arises when files of different types are converted. This is because different file types comprise different characteristics and properties which affect the resulting size of the file. For example, a paragraph of text comprises 38 words and 210 characters and can be written to a '.txt' file and a '.doc' file. The file size of the '.txt' file is 4.0 KB and the file size of the '.doc' file is 20 KB.

Thus it would be desirable to alleviate these and other problems associated with the related art.

SUMMARY OF THE INVENTION

Viewed from a first aspect, the present invention provides an apparatus for predicting a resultant attribute of a text file before the text file has been converted into an audio file, by a text-to-speech converter application, the apparatus comprising: a receiver component for receiving a text file and a request to determine a resultant attribute of the text file before it is converted to an audio file by a text-to-speech converter component; a calculation component for determining a file type associated with the received text file and a size of the received text file; a calculation component for identifying an attribute associated with the determined file type to be converted to an audio file; and a calculation component for determining from the identified attribute and the size of the received text file the resultant attribute of the text file before it is converted to an audio file by the text-to-speech converter component.

Advantageously, a user is able to use the predication calculation to decide how much data can be converted to fit onto available storage space, or given an amount of available storage space, how much playing time can be fitted into the available storage space.

Viewed from a second aspect, the present invention provides a method for predicting a resultant attribute of a text file before it has been converted into an audio file by a text-to-speech converter application, the method comprising: receiving a text file and a request to determine a resultant attribute of the text file before it is converted to an audio file by a text-to-speech converter component; determining a file type associated with the received text file and a size of the received text file; identifying an attribute associated with the determined file type to be converted to an audio file; and determining from the identified attribute and the size of the received text file a resultant attribute of the text file before it is converted to an audio file by the text-to-speech converter component.

Viewed from a third aspect, the present invention provides a computer program product loadable into the internal memory of a digital computer, comprising software code portions for performing, when the product is run on a computer, the invention as described above.

BRIEF DESCRIPTION OF THE DRAWINGS

Embodiments of the invention are described below in detail, by way of example only, with reference to the accompanying drawings.

DETAILED DESCRIPTION OF THE INVENTION

Figure 1:
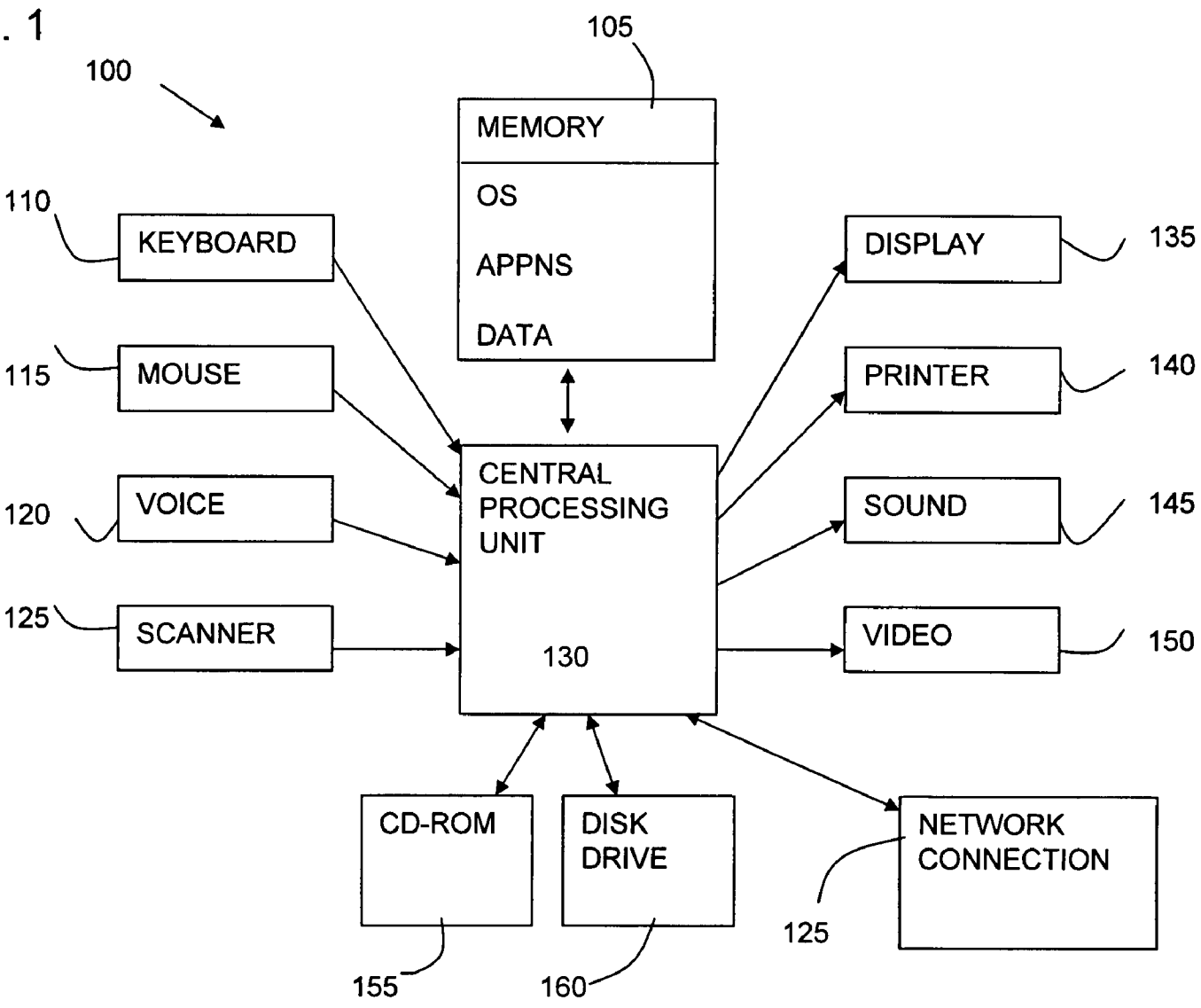
FIG. 1 is a block diagram showing a data processing system in which an embodiment of the present invention may be embodied.

Referring to FIG. 1 an example of data processing system 100 of the type that would be operable on a client device and a server is shown.

The data processing system 100 comprises a central processing unit 130 with primary storage in the form of memory 105 (RAM and ROM). The memory 105 stores program information and data acted on or created by application programs. The program information includes the operating system code for the data processing system 100 and application code for applications running on the computer system 100. Secondary storage includes optical disk storage 155 and magnetic disk storage 160. Data and program information can also be stored and accessed from the secondary storage.

The data processing system 100 includes a network connection means 105 for interfacing the data processing system 100 to a network 125. The data processing system 100 may also have other external source communication means such as a fax modem or telephone connection.

The central processing unit 130 comprises inputs in the form of, as examples, a keyboard 110, a mouse 115, voice input 120, and a scanner 125 for inputting text, images, graphics or the like. Outputs from the central processing unit 130 may include a display means 135, a printer 140, sound output 145, video output 150, etc.

Applications may run on the data processing system 100 from a storage means 160 or via a network connection 165, which may include database applications etc.

Figure 2:
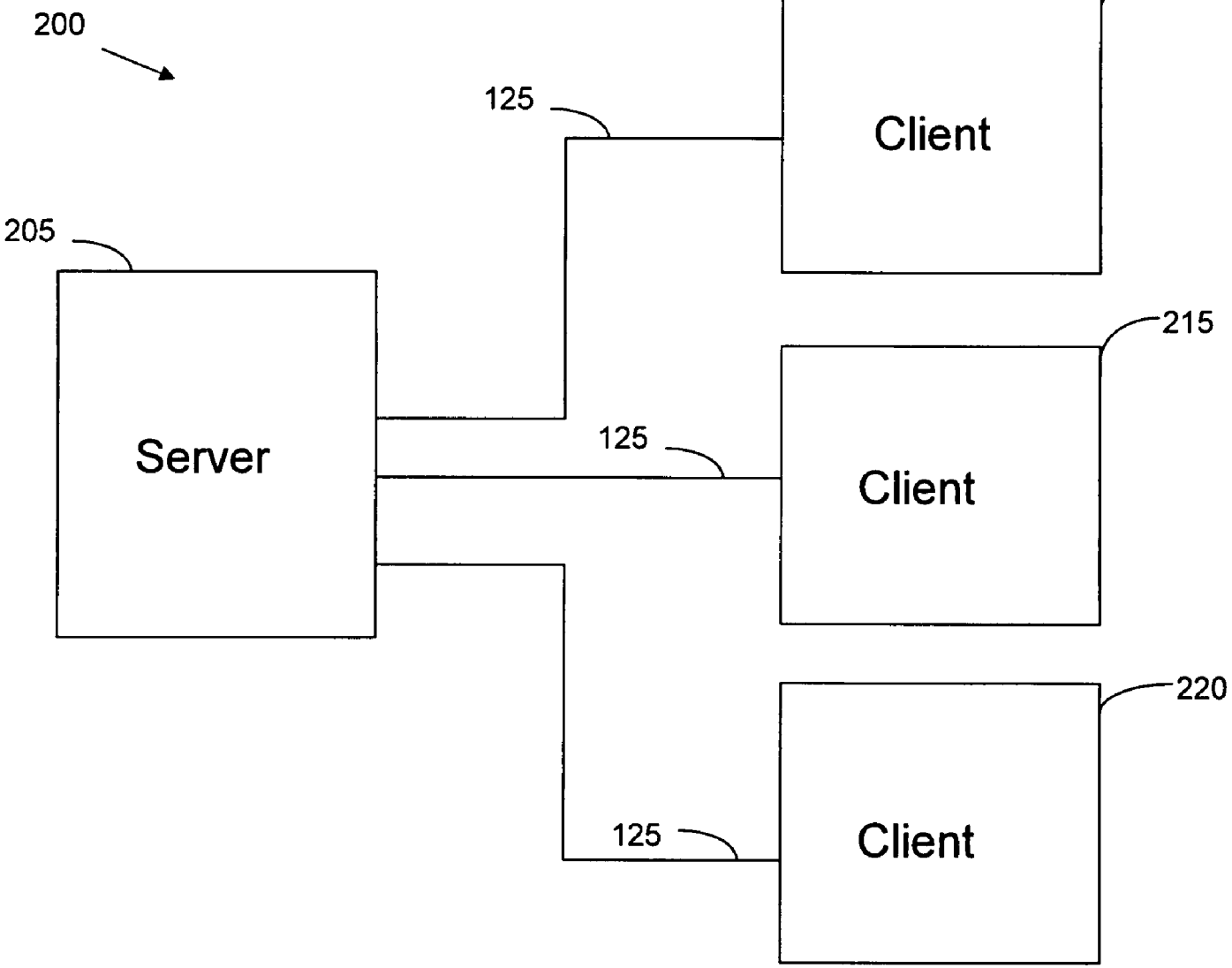
FIG. 2 is a block diagram showing a distributed data processing network in which an embodiment of the present invention may be embodied.

FIG. 2 shows a typical example of a client and server architecture 200 in which an embodiment of the invention may be operable. A number of client devices 210, 215, 220 are connectable via a network 125 to a server 205. The server 205 stores data which is accessible (with the appropriate access permissions) by one of or all of the client devices 210, 215, 220. The network 125 can be any type of network 225 including but not limited to a local area network, a wide area network, a wireless network, a fiber optic network etc. The server can be a web server or other type of application server. Likewise, a client device 210, 215, 220 may be a web client or any type of client device 210, 225, 220 which is operable for sending requests for data to and receiving data from the server 205.

Figure 3:
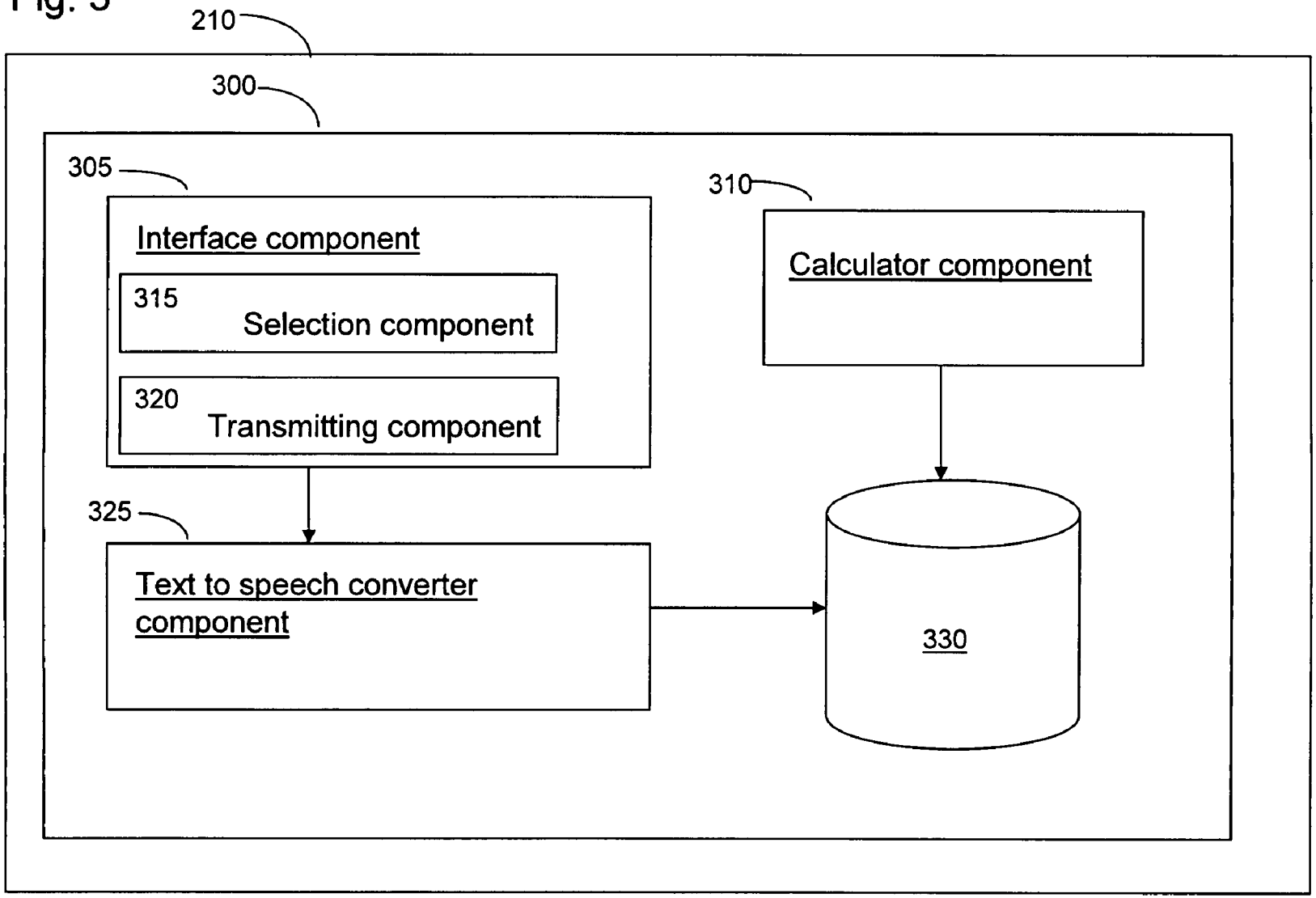
FIG. 3 is a block diagram showing a prediction component operable with a client side text-to-speech conversion component in accordance with an embodiment of the present invention.

Referring to FIG. 3 a block diagram is shown detailing the components of an embodiment of the present invention.

Client devices 210, 225, 220 comprise a prediction component 300 for predicting a resultant attribute of a text file before it is converted into an audio file. In an embodiment the attributes are for example, the predicted size of the file and the predicted length of the playing time of the file once converted into an audio file by a text-to-speech conversion component.

In a first embodiment the prediction component 300 comprises an interface component 305 comprising selection means 315 for selecting files for conversion and transmitting means 320 for transmitting files to a text-to-speech converter component 325 in a learning mode, a data store component 330 for storing the results of the output of the text-to-speech converter component 325 when in learning mode and a calculator component 310 for predicting a unit of time in audio per byte and the size of the text per byte of the text file if it were converted. Each of these components will be explained in turn.

Client devices 210, 215, 220 store a number text files that are to be converted into an audio file. The text files can be any form of text file which a user wishes to be converted into an audio file.

The interface component 305 comprises selection means 315 for allowing a user to select a file for conversion. The selection means 315 may comprise a drop down list displaying all files in a particular directory or the selection means 315 may comprise means for searching the client device's data store 330 for files to convert.

The interface component 305 also comprises selection means 315 for placing a text-to-speech converter component 325 into learning mode. The learning mode allows the text-to-speech converter component 325 to receive a text file of any type, for example, a '.doc' file, a '.txt' file, a '.pdf' file or a '.lwp' file in order to determine for a given file size, the predicted size of the text file before its is converted into an audio file and the predicted playing time in seconds of the text file once converted into an audio file.

For each different file type that a user wishes to predict the resultant size and playing time of, the text-to-speech converter component 325 goes through a process of parsing a text file associated with the file type to determine the size of the file, then convert the text file to an audio file and from this converted file determine the size of the file and the length of the playing time of the file.

Thus the text-to-speech converter component 325 produces a set of sample data for each different file type known to a user. For example, sample data associated with '.doc' files, sample data associated with '.txt' file, etc. It is the sample data associated with a file type that a calculator component uses in order to perform a prediction calculation to predict a resultant attribute of a text file (of the same file type) before it is converted to an audio file.

The prediction component 300 also comprises a calculator component 310 for predicting the size of a chosen file in bytes and length of playing time before it is converted into an audio file.

The calculator component 310 interfaces with the selection means 315 of the interface component 305 and is triggered when it receives a file that a user has selected to be converted into an audio file, from the selection means 315. The calculator component 310 determines from the file's properties the file type whether it is, for example, a '.doc' file or a '.pdf' file. The calculator component 310 accesses the table stored in the data store and accesses the relevant conversion data for the determined file type. Thus, the calculator component 310, using the accessed data and knowledge of the size of the selected file, performs a calculation to determine the following:

Seconds of audio per byte in order to predict the playing time of the text file once converted into audio; and Output bytes per input byte for the predication of the file size of the audio file produced.

For example, using the following data:

Size in bytes of file selected for conversion=1,000

File type='.doc'

Data logged by text-to-speech conversion component when in learning mode:

Size of a byte of data for a '.doc' file=660 bytes

Length of playing time in second for a byte a data of a '.doc' file=0.064 seconds For example, if the size of the '.doc' file=1,000 bytes, for every byte of data in the original file there are 660 bytes of data after conversion and for every byte of data before conversion there is 0.064 seconds of playing time. For 1,000 bytes of data before conversion there is a predicated 6,600,000 bytes of data and 640 seconds of playing time.

On return of the result, the user can make an informed decision as to how much data can be converted to suit an intended purpose. For example, N number of bytes of data can be converted to create S seconds of audio playing time.

The text-to-speech converter component 325 uses sample text similar to the text to be converted. So, for example, different word processing applications have different formats in which a text document is compiled and this affects the size of the resulting file. For example a '.doc' file may result in a larger file size than a '.txt' file due to white space characters and other characteristics of the file type.

Thus the text-to-speech conversion component 325 enters a period of 'learning', in which it receives text files of different file types in order to determine how many seconds of audio file are created for a given amount of bytes of data. Each text file which is received by the text-to-speech converter is parsed to determine how many bytes of data the file contains. Next, using known text-to-speech conversion methods, the text within the file is converted in to speech, for example, into an audio file. The text-to-speech conversion component 325 then determines the length of playing time in seconds of the converted file and the size of the converted file in bytes.

For example, if the size of the file to be converted is 1000 bytes and once the file has been converted into audio the size of the file is 6,600,000 bytes and the playing time in seconds is 640. Using the formulas below the calculator component 310 calculates the ratios for 1 byte of data and logs the calculations in the table as shown below.

To calculate the length of playing time in seconds

Time of sample file/size of file to be converted

To calculate the size of the file to be converted into bytes

Bytes of sample file/size of the file to be converted

TABLE 1

| File type | Bytes before conversion | Bytes after conversion | Length in seconds |
|---|---|---|---|
| .doc | 1 | 660 | 0.064 |
| .txt | 1 | — | — |
| .pdf | 1 | — | — |
| .wpr | 1 | — | — |
| .lwp | 1 | — | — |

Figure 4:
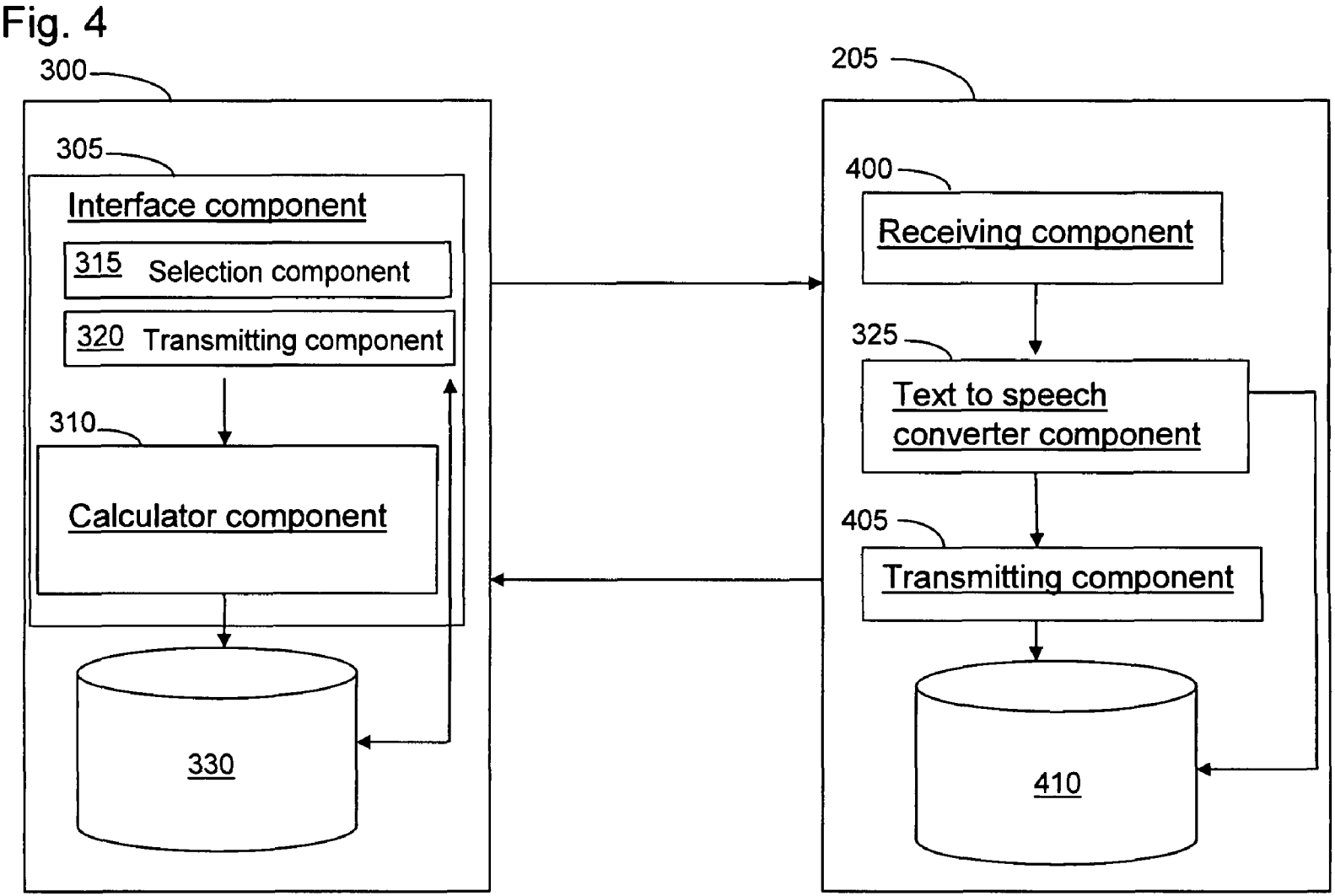
FIG. 4 is a block diagram showing a prediction component operable with a server side text-to-speech conversion.

Moving to FIG. 4, an alternative arrangement of FIG. 3 is shown, in which the text-to-speech converter component 325 is operable for operating on a server. In this example, the text-to-speech converter component 325 manages requests for conversions from a plurality of client device 210, 215, 220, but only when in learning mode. In this example, the calculator component 310 comprises additional logic that transmits file types determined as not received before by the predication component 300 to a receiving component 400 on the server 205. The receiving component 400 determines the size of the file and logs this information into a table stored in the data store 410. The receiving component 400 then transmits the file to the text-to-speech converter component 325 for converting into audio. Once, the file has been converted, the text-to-speech converter component 325 determines the size of the file and the length of the playing time and logs this information in the table in the data store 410. The remainder of the calculations are performed in the same manner using the same algorithms are previously explained with reference to FIG. 3.

Figure 5:
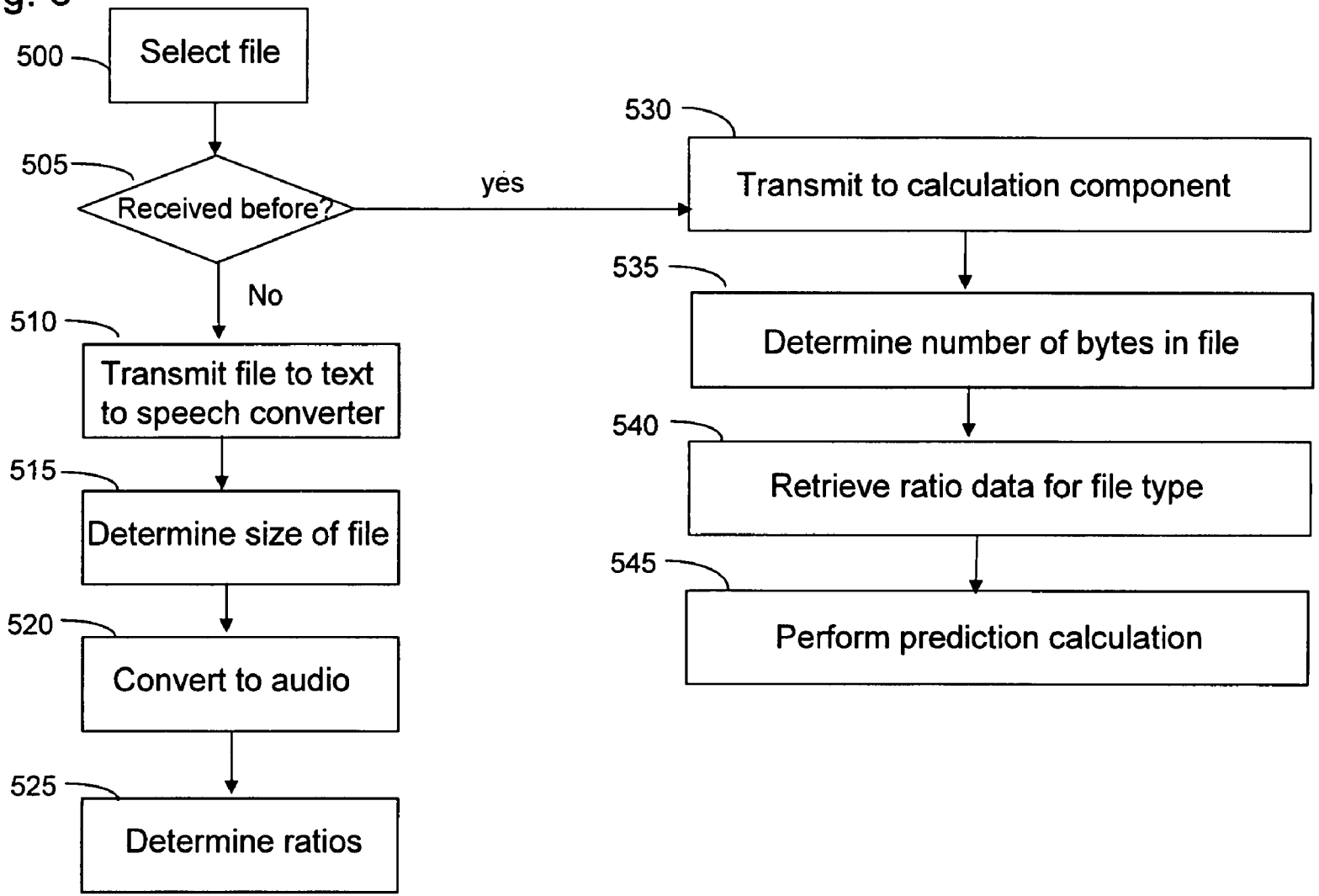
FIG. 5 is a flow chart detailing the client side process steps of the prediction component in accordance with an embodiment of the invention.

FIG. 5 is a flow chart explaining the process steps of an embodiment of the present invention. At step 500 a text file, for example, 'test.'doc, is selected via the selection means 315 of the interface component 305. The selection component 315 transmits a request to the calculation component 310 asking if this file type (.doc) has been received by the prediction component 300 on a previous occasion. If the determination is positive, i.e., the prediction component 300 has received this file type (.doc) before, control passes to step 530 and the properties of the file are transmitted to the calculation component for processing.

At step 535 the calculation component 310 determines the size of the file in bytes, for example, 10,000 bytes and at step 540 performs a lookup in the data store to determine the ratio data for this file type. For example:

| | | | |
|---|---|---|---|
| .doc | 1 | 660 | 0.064 |

Then using the above data the prediction component 300 calculates the predicted size and playing time of the file in bytes and seconds.

For example, size of '.doc' file=1,000 bytes. For every byte of data in the original file there are 660 bytes of data after conversion. Also for every byte of data before conversion there is 0.064 seconds of playing time. Thus for 1,000 bytes of data before conversion there is a predicated 6,600,000 bytes of data and 640 seconds of playing time.

Moving back to decision step 505, if the calculation component 310 determines that the file type (.doc) has not been received before, then control passes to step 510 and the selected file (.doc) is transmitted to the text-to-speech converter component 325 for processing. Next, at step 515 the text-to-speech conversion component 325 determines the size of the file and logs this information along with the file type in a table. The text-to-speech converter component 325 proceeds to convert the text into audio and logs in the same table the size and the playing time of the converted file in bytes and seconds at step 520. Control then passes to the calculation component and the calculation component calculates the individual ratios by using the following formulas at step 525.

To calculate the length of playing time in seconds

Time of sample file/size of file to be converted

To calculate the size of the file to be converted into bytes

Bytes of sample file/size of the file to be converted

The calculated results are then logged in to the table for use by the calculation component 310 for performing further prediction calculations on received files of the same file type.

It will be clear to one of ordinary skill in the art that all or part of the method of the embodiments of the present invention may suitably and usefully be embodied in a logic apparatus, or a plurality of logic apparatus, comprising logic elements arranged to perform the steps of the method and that such logic elements may comprise hardware components, firmware components or a combination thereof.

It will be equally clear to one of skill in the art that all or part of a logic arrangement according to the embodiments of the present invention may suitably be embodied in a logic apparatus comprising logic elements to perform the steps of the method, and that such logic elements may comprise components such as logic gates in, for example a programmable logic array or application-specific integrated circuit. Such a logic arrangement may further be embodied in enabling elements for temporarily or permanently establishing logic structures in such an array or circuit using, for example, a virtual hardware descriptor language, which may be stored and transmitted using fixed or transmittable carrier media.

It will be appreciated that the method and arrangement described above may also suitably be carried out fully or partially in software running on one or more processors (not shown in the figures), and that the software may be provided in the form of one or more computer program elements carried on any suitable data-carrier (also not shown in the figures) such as a magnetic or optical disk or the like. Channels for the transmission of data may likewise comprise storage media of all descriptions as well as signal-carrying media, such as wired or wireless signal-carrying media.

A method is generally conceived to be a self-consistent sequence of steps leading to a desired result. These steps require physical manipulations of physical quantities. Usually, though not necessarily, these quantities take the form of electrical or magnetic signals capable of being stored, transferred, combined, compared, and otherwise manipulated. It is convenient at times, principally for reasons of common usage, to refer to these signals as bits, values, parameters, items, elements, objects, symbols, characters, terms, numbers, or the like. It should be noted, however, that all of these terms and similar terms are to be associated with the appropriate physical quantities and are merely convenient labels applied to these quantities.

The present invention may further suitably be embodied as a computer program product for use with a computer system. Such an implementation may comprise a series of computer-readable instructions either fixed on a tangible medium, such as a computer readable medium, for example, diskette, CD-ROM, ROM, or hard disk, or transmittable to a computer system, via a modem or other interface device, over either a tangible medium, including but not limited to optical or analogue communications lines. The series of computer readable instructions embodies all or part of the functionality previously described herein.

Those skilled in the art will appreciate that such computer readable instructions can be written in a number of programming languages for use with many computer architectures or operating systems. Further, such instructions may be stored using any memory technology, present or future, including but not limited to, semiconductor, magnetic, or optical. It is contemplated that such a computer program product may be distributed as a removable medium with accompanying printed or electronic documentation, for example, shrink-wrapped software, pre-loaded with a computer system, for example, on a system ROM or fixed disk, or distributed from a server or electronic bulletin board over a network, for example, the Internet or World Wide Web.

In one alternative, embodiments of the present invention may be realized in the form of a computer implemented method of deploying a service comprising steps of deploying computer program code operable to, when deployed into a computer infrastructure and executed thereon, causes the computer system to perform all the steps of the method.

In a further alternative, embodiments of the present invention may be realized in the form of data carrier having functional data thereon, the functional data comprising functional computer data structures to, when loaded into a computer system and operated upon thereby, enable the computer system to perform all the steps of the method.

It will be clear to one skilled in the art that many improvements and modifications can be made to the foregoing exemplary embodiments without departing from the scope of the present invention.

The invention claimed is:

1. An apparatus comprising:

a receiver component configured to receive a text file and a request to predict a resultant attribute of an audio file to be converted from the text file by a text-to-speech converter component;

a determining component configured to determine a file type associated with the received text file and a size of the received text file;

an identifying component configured to identify an attribute associated with the determined file type; and a predicting component configured to predict, using the identified attribute and the size of the received text file, the resultant attribute of the audio file to be converted from the text file by the text-to-speech converter component;

wherein the receiver component, the determining component, the identifying component and the predicting component each is implemented via a component selected from the group consisting of a programmed processor and a logic apparatus;

wherein the resultant attribute comprises a size of the audio file.

2. An apparatus as claimed in claim 1, wherein the resultant attribute comprises a length of playing time of the audio file and a size of the audio file.

3. An apparatus as claimed in claim 2, wherein the length of the playing time is in seconds and the size of the converted text file is in bytes.

4. An apparatus as claimed in claim 1, wherein the determining component is configured to determine if the identified file type has been received on a previous occasion and in response to a negative determination to transmit the received text file to the text-to-speech converter component for converting into the audio file.

5. An apparatus as claimed in claim 4, wherein the text-to-speech converter component is configured to determine a size of the received text file and to determine for an identified byte of text data a size of the byte of data once converted into the audio file and a playing time of the byte of data once converted into the audio file.

6. An apparatus as claimed in claim 1, wherein the identified attribute is stored in a list of other attributes associated with other different determined file types.

7. A method comprising:

receiving a text file and a request to predict a resultant attribute of an audio file to be converted from the text file by a text-to-speech converter component;

determining a file type associated with the received text file and a size of the received text file;

identifying an attribute associated with the determined file type; and predicting, using the identified attribute, a programmed processor, and the size of the received text file, the resultant attribute of the audio file to be converted from the text file by the text-to-speech converter component;

wherein the resultant attribute comprises a size of the audio file.

8. A method as claimed in claim 7, wherein the resultant attribute comprises a length of playing time of the converted text file or a size of the converted text file.

9. A method as claimed in claim 8, wherein the length of the playing time is in seconds and the size of the converted text file is in bytes.

10. A method as claimed in claim 7, further comprising:

determining if the identified file type has been received on a previous occasion and in response to a negative determination transmitting the received text file to the text-to-speech converter component for converting into an audio file.

11. A method as claimed in claim 10, further comprising:

determining the size of the received text file and determining for an identified byte of text data a size of the byte of data once converted into the audio file and a playing time of the byte of data once converted into the audio file.

12. A method as claimed in claim 7, wherein the identified attribute is stored in a list of other attributes associated with other different determined file types.

13. A tangible computer readable medium encoded with computer-readable instructions that, when executed, perform a method comprising:

receiving a text file and a request to predict a resultant attribute of an audio file to be converted from the text file by a text-to-speech converter component;

determining predicting a file type associated with the received text file and a size of the received text file;

identifying an attribute associated with the determined file type; and predicting from the identified attribute and the size of the received text file the resultant attribute of the audio file to be converted from the text file by the text-to-speech converter component;

wherein the resultant attribute comprises a size of the audio file.

14. An apparatus comprising:

a receiver component configured to receive a text file and a request to predict a resultant attribute of an audio file to be converted from the text file by a text-to-speech converter component;

a determining component configured to determine a file type associated with the received text file and a size of the received text file;

an identifying component configured to identify an attribute associated with the determined file type; and a predicting component configured to predict, using the identified attribute and the size of the received text file, the resultant attribute of the audio file to be converted from the text file by the text-to-speech converter component;

wherein the receiver component, the determining component, the identifying component and the predicting component each is implemented via a component selected from the group consisting of a programmed processor and a logic apparatus; and wherein the identified attribute is a ratio of, for one byte of data of the received text file, a size of the byte of data once converted to audio.

15. An apparatus, comprising:

a receiver component configured to receive a text file and a request to predict a resultant attribute of an audio file to be converted from the text file by a text-to-speech converter component;

a determining component configured to determine a file type associated with the received text file and a size of the received text file;

an identifying component configured to identify an attribute associated with the determined file type; and a predicting component configured to predict, using the identified attribute and the size of the received text file, the resultant attribute of the audio file to be converted from the text file by the text-to-speech converter component;

wherein the receiver component, the determining component, the identifying component and the predicting component each is implemented via a component selected from the group consisting of a programmed processor and a logic apparatus; and wherein the identified attribute is a ratio of, for a byte of data identified in the received text file, a playing time, in seconds, of the identified byte of data once converted to audio.

16. A method comprising:

receiving a text file and a request to predict a resultant attribute of an audio file to be converted from the text file by a text-to-speech converter component;

determining a file type associated with the received text file and a size of the received text file;

identifying an attribute associated with the determined file type; and predicting, using the identified attribute, a programmed processor, and the size of the received text file, the resultant attribute of the audio file to be converted from the text file by the text-to-speech converter component;

wherein the identified attribute is a ratio of, for one byte of data of the received text file, a size of the byte of data once converted to audio.

17. A method, comprising:

receiving a text file and a request to predict a resultant attribute of an audio file to be converted from the text file by a text-to-speech converter component;

determining a file type associated with the received text file and a size of the received text file;

identifying an attribute associated with the determined file type; and predicting, using the identified attribute, a programmed processor, and the size of the received text file, the resultant attribute of the audio file to be converted from the text file by the text-to-speech converter component;

wherein the identified attribute is a ratio of, for a byte of data identified in the received text file, a playing time, in seconds, of the identified byte of data once converted to audio.

* * * * *